US005628405A

United States Patent [19]

Price et al.

[11] Patent Number: 5,628,405

[45] Date of Patent: May 13, 1997

[54] CONTAINMENT APPARATUS WITH PERFORATED SUPPORT PLATFORM

[75] Inventors: Therese Price, 855 Christiansen Rd., Toledo, Oreg. 97391; Doc Holliday, Toledo, Oreg.

[73] Assignee: Therese Price, Toledo, Oreg.

[21] Appl. No.: 569,791

[22] Filed: Dec. 8, 1995

[51] Int. Cl.[6] ..... B65D 25/04

[52] U.S. Cl. ..... 206/561; 220/571; 220/DIG. 6

[58] Field of Search ..... 206/557, 561, 206/566, 372, 373; 220/625, 630, 503, 504, 529, DIG. 6, 572, 571

[56] References Cited

U.S. PATENT DOCUMENTS 237,983 2/1881 Kenworthy ..... 220/572
1,961,391 6/1934 Reedy et al. .
2,058,864 10/1936 Goulooze .
4,169,532 10/1979 Scapellati .
5,184,749 2/1993 Attenusio ..... 220/572

*Primary Examiner*—Jacob K. Ackun
*Attorney, Agent, or Firm*—Steven J. Adamson

[57] ABSTRACT

A containment apparatus for holding an item such that it is separate from debris, comprising a frame having side walls including a first engaging member and a second engaging member located under the first. A perforated support platform is mounted to the frame at the first engaging member while a receiving tray is mounted at the second engaging member. Debris in the holder passes through platform perforations into the receiving tray and can then be removed efficiently during cleaning. Several embodiments are disclosed which include the tray and platform being individually fixed or removable and side walls of various heights. A plurality of dividers and subdivider may optionally be provided to divide the exterior surface of the platform into a plurality of compartments.

13 Claims, 3 Drawing Sheets

CONTAINMENT APPARATUS WITH PERFORATED SUPPORT PLATFORM

FIELD OF THE INVENTION

The present invention relates to a device for holding implements such as eating and food preparation utensils, away from associated debris.

BACKGROUND OF THE INVENTION

Several devices exist for holding implements and they include, but are not limited to, injection molded utensil holders or more formal velvet lined silverware boxes, ornately fashioned jewelry boxes, tool or part boxes with sliding trays, and the like. A problem with these types of holding devices, however, is that they cannot be easily cleaned and, therefore, lead to an undesirable build-up of debris in the compartments wherein their respective items are held.

For example, conventional injection molded utensil holders or the like are often kept in a kitchen cabinet drawer just under the counter top. When the drawer is open dust, bread crumbs, and other matter lands in the utensil holder and over time the accumulation of debris can become significant, becoming both unsightly, and potentially even causing health risks. To clean the holder it is necessary to remove all of the utensils therefrom, reach into the corners and wipe or scrub as appropriate, dry, and replace the utensils in their appropriate position. Thus, present holding devices permit unsightly accumulations of dirt and other debris and are difficult to clean.

SUMMARY OF THE INVENTION

Accordingly, it is the object of the present invention to provide a device for supporting an item in such a manner as to separate that item from debris.

It is another object of the present invention to provide such a device with a raised perforated platform and receiving means therebelow for receiving debris.

It is a further object of the present invention to configure the device such that the receiving means is easily cleanable.

These and related objectives of the present invention are achieved by use of a containment apparatus for holding an item separate from debris as described herein. Such an apparatus includes, in one embodiment, a frame having side walls including first engaging means and second engaging means positioned under the first engaging means; a perforated support platform mounted to the frame at the first engaging means; receiving tray means mounted to the frame at the second engaging means; and wherein the receiving tray means is removable to facilitate removal of debris that has passed through the perforated platform. The platform may also be removable to facilitate cleaning, etc.

In another embodiment, the containment apparatus includes a frame having side walls and a bottom; a perforated support platform mounted to said frame above and spaced apart from said bottom; wherein said bottom includes means for receiving debris that passes through perforations in said platform; and further wherein at least one of said side walls has a generally horizontal opening positioned between the platform and the bottom through which debris can be expelled.

The containment apparatus or "holding device" may include one or more dividers and/or subdividers to define a plurality of compartments on the surface of the platform. These divider and subdividers may be removable and rearrangable. They may also be provided in various shapes that define, for example, compartments that are generally concave in cross-section.

Other embodiments of the present invention include providing a plurality of individual trays for an equal plurality of compartments. Also, the height of the side walls can be adjusted to extend from a height of 0" above the exterior surface of the platform to any practical value.

The attainment of the foregoing and related advantages and features of the invention should be more readily apparent to those skilled in the art, after review of the following more detailed description of the invention taken together with the drawings.

DETAILED DESCRIPTION

Figure 1:
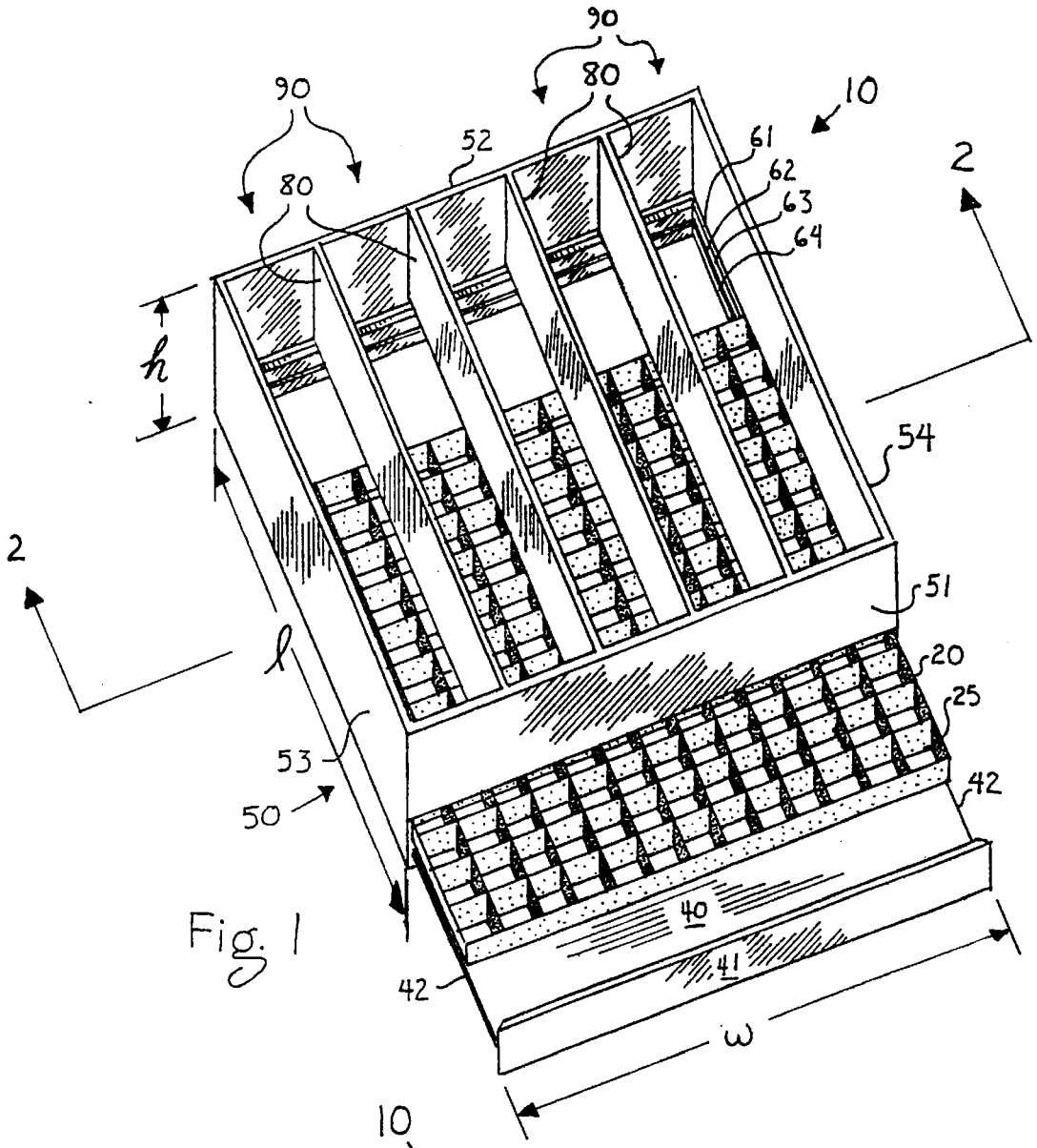
FIG. 1 is a perspective view of a holding device in accordance with the present invention.

Referring to FIG. 1, a perspective view of a holding device 10 in accordance with the present invention is shown. The device 10 includes a perforated support platform 20, which in the embodiment FIG. 1, is preferably removable. A tray 40 is provided below perforated platform 20 to receive debris which falls therethrough. A front plate 41 is attached at a front end of the tray 40 to facilitate handling of the tray, containment of debris and for aesthetic purposes. The platform 20 and tray 40 fit into a frame 50 which includes a front wall 51, back wall 52, left wall 53, and a right wall 54. These walls may culminate at approximately the level of the surface of platform 20 as illustrated below in FIG. 6 or may extend a predefined distance above platform 20 as illustrated in FIG. 1. The frame 50 also includes a slot 61 for removably receiving the platform 20 and a groove 62 for removably receiving tray 40. The slot 61 and groove 62 are separated by interior lip 63, while exterior lip 64 defines a bottom of groove 62. Dividers 80 may be provided to segregate the surface of platform 20 into a plurality of compartments 90. The dividers may be removable or permanently affixed. In one embodiment of removable dividers, shallow slots are provided on the interior surfaces of front and back side walls 51,52 (or alternatively left and right side walls 53,54) for receiving the distal ends of corresponding dividers 80.

Having generally introduced the holding device, the above-recited components and aspects related thereto are now discussed in more detail.

The perforated platform is formed of a generally rigid, non-brittle, washable material such as wood or plastic or the like. The individual perforations therein 25 are formed of an appropriate dimension for both supporting the item to be held while permitting debris normally associated with that item or from the environment in which the holding device is used to pass through the perforations into the receiving tray 40. The removable tray 40 is formed of appropriate dimensions and is spaced from platform 20 in such a manner as to collect debris that has passed through perforations 25. A lip may be provided along the edges, generally represented by reference numeral 42, of tray 40 to facilitate a containment of debris on tray 40. The tray may be made of any suitable material which is both rigid, with minimal flexibility, and washable.

The sidewalls 51–54 are also configured of a rigid and washable material, such as finished wood or plastic or the like as are the dividers 80.

Referring to the engaging arrangement of slot 61 with platform 20 and groove 62 with tray 40, the illustrated arrangement is preferred because it is practical and can be readily machined. Alternatively, however, runner mechanisms can be provided for more fluid movement of the platform or tray from the holder or the tray 40 could simply snap onto the bottom of the holder 10, etc.

Figure 2:
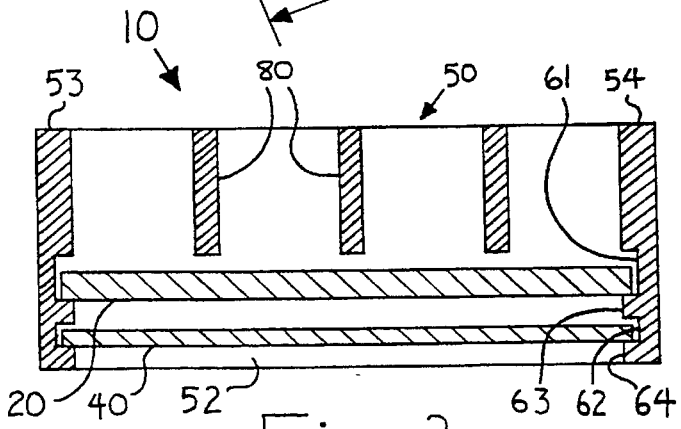
FIG. 2 is a cross sectional view of the holding device of FIG. 1 taken along line 2—2.

Referring to FIG. 2, a cross-sectional view of the holding device 10 of FIG. 1 is shown. Amongst other features, FIG. 2 illustrates the relationship of slot 61, groove 62, interior lip 63 and exterior lip 64. If the sidewalls 53 and 54 are formed of wood, slot 61 and groove 62 may be formed by a router or similar device. If the frame 50 is formed by injection molding, the slot 61 and groove 62 will be defined by the injection mold.

In a preferred embodiment for use as a holder of kitchen utensils (including eating and food preparation utensils) that could be placed either in a drawer or on a counter top or the like, the device 10 has approximately the following dimensions: height, h, equal 3", width, w, equal 15", length, l, equal 15". The slot 61 is approximately ½" wide and the groove 62 is preferably ¼" wide. The dividers are preferably ¼" thick and the width of the side walls 51–54 is preferably ½".

Figure 3:
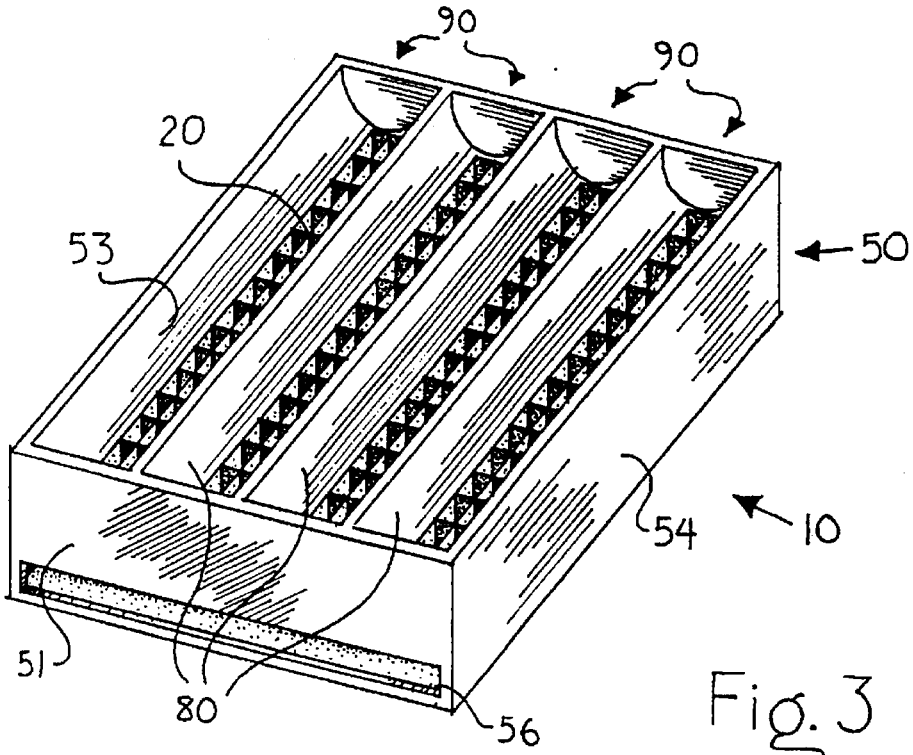
FIG. 3 is a perspective view of an alternative embodiment of the holding device in which the compartments have a generally concave configuration in accordance with the present invention.

Referring to FIG. 3, a perspective view of an alternative embodiment of the device holder in accordance with the present invention is shown. The device 10 of FIG. 3 is similar to that of FIG. 1 with the exception, amongst others, that the compartments 90 are concave in cross-section due to the use of appropriately shaped dividers 80 and side walls 53,54. The concave configuration tends to center debris and items held in the compartments. The embodiment of FIG. 3, also illustrates a platform 20 that is not removable. A non-removable platform may be achieve by gluing the platform in the frame 50, by providing a front side wall 51 that extend down in front of the platform, by forming the frame and platform integrally in injection molded plastic, or any other known manner.

It should also be recognized in FIG. 3 that a receiving tray is formed integrally with the frame to define a bottom of the device 10. For cleaning, the device is tilted forward so that debris exits the device under the force of gravity through opening 56. Alternatively, a removable tray such as tray 40 of FIG. 1 can be placed in opening 56 to facilitate containment and removal of debris.

Figure 4:
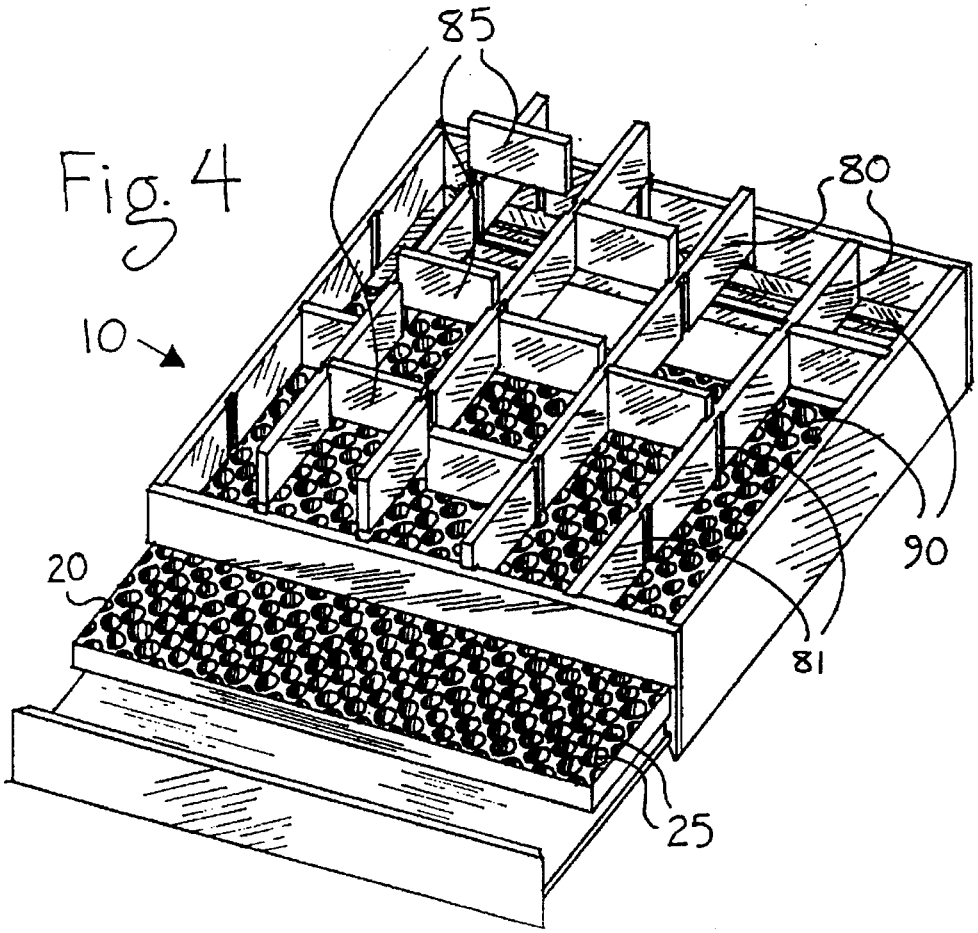
FIG. 4 is a perspective view of an alternative embodiment of the holding device illustrating a plurality of sub-dividers in accordance with the present invention.

Referring to FIG. 4, a perspective view of an alternative embodiment of the holding device 10 in accordance with the present invention as shown. The embodiment of FIG. 4 is similar to that of FIG. 1, while additionally providing a plurality of removable, adjustable subdividers 85. The use of subdividers 85 permits a division of the usable surface of platform 20 into a significantly greater number of compartments 90 than mere use of dividers 80. This feature may be particularly applicable to a jewelry or parts box implementation or the like. The subdividers may be mated with the dividers 80 through the use of grooves 81 formed in dividers 80 similar in manner to how the dividers may connect to the side walls. The device holder 10 of FIG. 4 also illustrates the formation of perforation 25 that are circular in shape. It should be recognized that all shapes and patterns of perforations are contemplated and as noted above, specific dimensions and configurations for the perforations will depend on the intended use.

Figure 5:
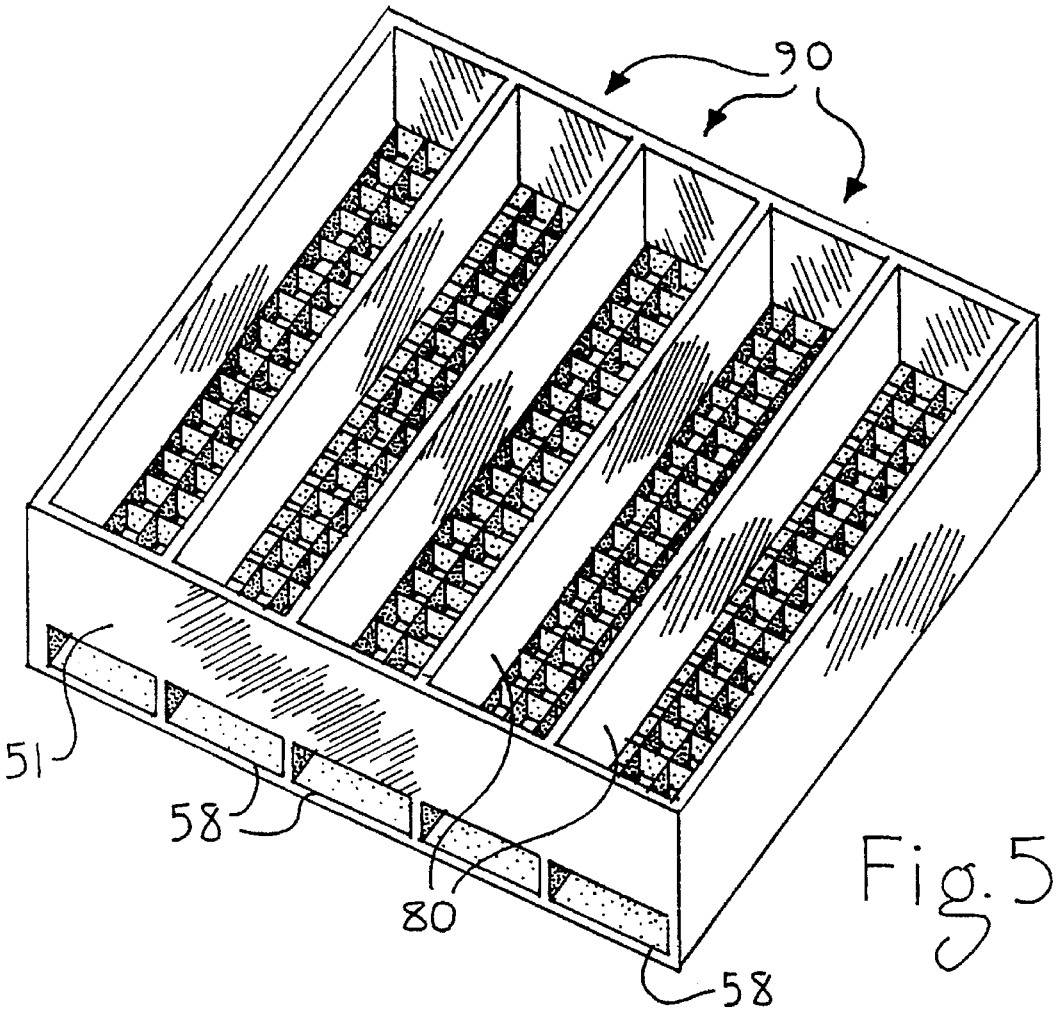
FIG. 5 is a perspective view of an alternative embodiment of the holding device in which separate openings are provided in a front side wall for each compartment in accordance with the present invention.

Referring to FIG. 5, a perspective view of an alternative embodiment of the holding device 10 in accordance with the present invention is shown. In this embodiment, openings 58 are provided in front wall 51 for each of the plurality of compartments 90 defined by dividers 80. As was the case for the holding device of FIG. 3, the bottom of the device may serve as the receiving member and debris may be removed by gravity or other forces, or individual removable trays can be provided for each opening 58. Guides (not shown) may be provided under each divider 80 to direct an individual tray.

Figure 6:
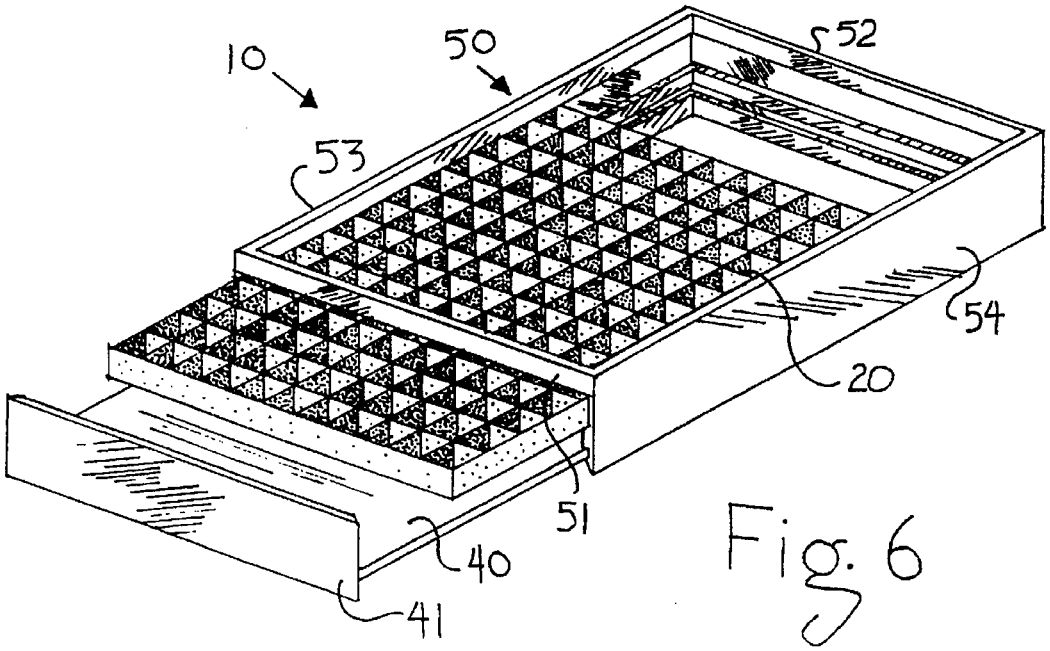
FIG. 6 is a perspective view of an alternative embodiment of the holding device substantially without side walls that extend above the exterior surface of the perforated platform in accordance with the present invention.

Referring to FIG. 6, a perspective view of yet another alternative embodiment of the holding device 10 is shown. In this embodiment, the side walls 51–54 are configured such that they do not extent significantly above the exterior surface of platform 20. The low side walls are preferably approximately ¼–½" or the like in height and thereby permit an appropriate level of containment while permitting unimpeded inspection, etc., of an item on platform 20.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

We claim:

1. An apparatus for holding kitchen utensils apart from associated debris, comprising:

a frame having a front wall and back wall connected by opposing side walls, each wall being configured in a planar fashion with a top of each wall being located within a common plane substantially perpendicular to the planes of each wall, and further wherein the planar area of said back wall is greater than that of said front wall such that an opening into said frame is defined at said front wall;

support platform receiving means disposed linearly along the inside of each of said side walls and within a plane parallel to said common perpendicular plane;

a planar perforated support platform translatable by a user along said support platform receiving means from an inserted position where said support platform is contained within the frame and a removed position where said support platform is removed from the frame, said support platform receiving means being positioned such that said support platform is removed and inserted through said opening defined at said front face;

debris tray receiving means disposed linearly along the inside of each of said side walls and within a plane parallel to said common perpendicular plane yet below that of said support platform receiving means and above a bottom portion of said side walls;

debris tray translatable by a user along said debris tray receiving means from an inserted position where said debris tray is contained within the frame and a removed position where said debris tray is removed from the frame, said debris tray receiving means being positioned such that said debris tray is removed and inserted through said opening defined at said front face;

a front plate formed on a front end of said debris tray, said front plate being configured such that when said debris tray is in an inserted position, the front plate is generally flush with said front wall and substantially fills said opening so as to prevent movement of the perforated support platform through the opening; and a plurality of divider arranged between said front and back walls generally in parallel with said side walls.

2. The apparatus of claim 1, wherein said perforated support platform is configured to have a minimal physical surface area sufficient to retain eating and food preparation utensils while permitting debris usually associated therewith to move by the force of gravity through the perforations onto the debris tray.

3. The apparatus of claim 1, further comprising at least one subdivider mounted to a divider.

4. The apparatus of claim 1, wherein said divider is removable.

5. The apparatus of claim 1, wherein at least one of said dividers has a cross-sectional configuration that is at least in part concave.

6. An apparatus for holding kitchen utensils apart from associated debris, comprising:

a frame having a front wall and a back wall connected by opposing side walls, each wall configured in a planar fashion with a top of each wall located within a common plane substantially perpendicular to the planes of each wall;

a substantially planar bottom fixedly connected to a bottom portion of said back and side walls in such a manner that the plane of said bottom is generally parallel to said common perpendicular plane and said bottom is spaced from a bottom portion of said front wall such that an opening is defined at said front wall immediately above and running substantially the entire length of a front portion of said bottom;

a substantially planar perforated support platform fixedly mounted to each of said walls, wherein said support platform is provided in a plane substantially parallel with said bottom and said opening is defined at said front wall so as to run linearly between said support platform and said bottom; and a plurality of divider fixedly mounted to said front and back walls and disposed generally in parallel with said side walls.

7. The apparatus of claim 6, wherein said apparatus is formed of injection molded plastic.

8. The apparatus of claim 6, wherein at lease one of said dividers has a cross-sectional configuration that is at least in part concave.

9. The apparatus of claim 6, further comprising a substantially planar, slidably removable debris receiving tray having a planar surface area at least equal to that of said support platform and configured of dimensions sufficient to permit insertion through said opening such that said tray is position between said support platform and said bottom in an inserted position.

10. The apparatus of claim 9, wherein said debris receiving tray further comprises a front plate which covers said opening and is aligned in a substantially flush manner with an exterior surface of said front wall when said tray is in said inserted position.

11. The apparatus of claim 6, wherein said perforated support platform is configured to have a minimal physical surface area sufficient to retain eating and food preparation utensils while permitting debris usually associated therewith to move by the force of gravity through the perforations onto the bottom, from where such debris may be expelled through said opening by the force of gravity when the back of said apparatus is tilted up.

12. An apparatus for holding kitchen utensils apart from associated debris, comprising:

a frame having a front wall and a back wall connected by opposing side walls, each wall configured in a planar fashion with a top of each wall located within a common plane substantially perpendicular to the planes of each wall;

a substantially planar bottom fixedly connected to said back and side walls in such a manner that the plane of said bottom is generally parallel to said common perpendicular plane;

a plurality of dividers fixedly connected to said front and back walls and said bottom and disposed generally in parallel with said side walls so as to form a plurality of compartments between said side walls, each compartment separated by one of said dividers;

a plurality of substantially planar perforated support platforms provided one each in each of said compartments and arranged in a plane substantially parallel to said bottom; and wherein said front wall is configured to define a plurality of openings, the location of the openings being further defined by the location of said dividers such that one opening is provided per compartment, each opening being provided between the support platform of its compartment and the bottom, immediately above and running linearly along a front portion of the bottom.

13. The apparatus of claim 12, wherein at least one of said dividers has a cross-sectional configuration that is at least in part concave.

* * * * *